US009512665B2

(12) United States Patent
Alvarado

(10) Patent No.: US 9,512,665 B2
(45) Date of Patent: Dec. 6, 2016

(54) UNIVERSAL FENESTRATION CAP SYSTEM AND METHOD

(71) Applicant: Jorge Alvarado, Glendale, CA (US)

(72) Inventor: Jorge Alvarado, Glendale, CA (US)

( * ) Notice: Subject to any disclaimer, the term of this patent is extended or adjusted under 35 U.S.C. 154(b) by 0 days.

(21) Appl. No.: 13/773,275

(22) Filed: Feb. 21, 2013

(65) Prior Publication Data

US 2013/0160395 A1 Jun. 27, 2013

Related U.S. Application Data

(60) Continuation of application No. 13/225,131, filed on Sep. 2, 2011, now abandoned, which is a division of application No. 11/027,860, filed on Dec. 30, 2004, now Pat. No. 8,024,898.

(51) Int. Cl.

| | |
|---|---|
| ***E06B 3/66*** | (2006.01) |
| ***E06B 1/32*** | (2006.01) |
| ***E06B 1/02*** | (2006.01) |
| ***E06B 1/62*** | (2006.01) |
| *E06B 1/68* | (2006.01) |

(52) U.S. Cl.

CPC ..... *E06B 1/325* (2013.01); *E06B 1/02* (2013.01); *E06B 1/62* (2013.01); *E06B 1/68* (2013.01)

(58) Field of Classification Search

CPC ..... E06B 1/02; E06B 1/62; E06B 1/68; E06B 1/325

USPC ..... 52/211, 204.1, 204.5, 208, 213, 656.1, 52/656.7, 656.4, 656.5; 49/504

See application file for complete search history.

(56) References Cited

U.S. PATENT DOCUMENTS

| | | | | | |
|---|---|---|---|---|---|
| 2,663,388 | A | * | 12/1953 | Anderson | 52/204.55 |
| 2,963,126 | A | * | 12/1960 | Cudini | 52/302.6 |
| 3,984,954 | A | * | 10/1976 | Takeda | 52/202 |
| 4,055,923 | A | * | 11/1977 | Biebuyck | 52/235 |
| 4,411,111 | A | * | 10/1983 | Hosooka | 52/204.55 |
| 4,420,919 | A | * | 12/1983 | Weber | 52/204.595 |
| 4,612,743 | A | * | 9/1986 | Salzer | 52/208 |
| 4,875,316 | A | * | 10/1989 | Johnston | 52/204.593 |
| 5,095,672 | A | * | 3/1992 | Tanikawa | 52/215 |
| 5,596,851 | A | * | 1/1997 | Ting | 52/211 |
| 5,660,010 | A | * | 8/1997 | Sayers | 52/217 |
| 5,675,947 | A | * | 10/1997 | Yane | 52/207 |
| 5,746,032 | A | * | 5/1998 | Koike et al. | 52/204.1 |
| 5,941,033 | A | * | 8/1999 | Adams | 52/212 |
| 5,979,129 | A | * | 11/1999 | Azar | 52/211 |
| 6,055,782 | A | * | 5/2000 | Morton et al. | 52/204.1 |
| 6,158,182 | A | * | 12/2000 | Biebuyck | 52/235 |
| 6,161,344 | A | * | 12/2000 | Blanchett | 52/97 |

(Continued)

*Primary Examiner* — James Buckle, Jr.

(74) *Attorney, Agent, or Firm* — Lewis Roca Rothgerber Christie, LLP

(57) ABSTRACT

In an exemplary embodiment, a window sill comprises a structural base having a first side and a second side, a fenestration cap attached to the structural base, a window frame mounted on the fenestration cap and finish elements applied to the structural base and adjacent to the fenestration cap. The window frame may be removed from the fenestration cap without disturbing the finish elements. Alternatively, a method of installing a window in a window opening comprises providing a window opening and preparing the window opening for receiving a fenestration cap, installing a fenestration cap by placement within and attachment to the window opening in a primary step, and installing a window within the window opening by placement within and attachment to the fenestration cap in a secondary step.

27 Claims, 12 Drawing Sheets

(56) References Cited

U.S. PATENT DOCUMENTS

| | | | | |
|---|---|---|---|---|
| 6,182,405 | B1 * | 2/2001 | Lindahl | 52/204.1 |
| 6,223,484 | B1 * | 5/2001 | Minter | 52/213 |
| 6,308,475 | B1 * | 10/2001 | Crish et al. | 52/204.597 |
| 6,334,283 | B1 * | 1/2002 | Edger | 52/204.1 |
| 6,412,240 | B1 * | 7/2002 | Treleven et al. | 52/208 |
| 6,715,248 | B2 * | 4/2004 | Biebuyck | 52/235 |
| 2002/0095885 | A1 * | 7/2002 | Sampson | 52/202 |
| 2002/0100234 | A1 * | 8/2002 | Sprague | 52/208 |
| 2003/0208970 | A1 * | 11/2003 | Saelzer | 52/167.1 |
| 2003/0226320 | A1 * | 12/2003 | Engebretson | 52/204.5 |
| 2003/0226321 | A1 * | 12/2003 | Engebretson | 52/204.54 |
| 2009/0255196 | A1 * | 10/2009 | Nirel et al. | 52/204.53 |

* cited by examiner

UNIVERSAL FENESTRATION CAP SYSTEM AND METHOD

CROSS-REFERENCE TO RELATED APPLICATION

This application is a continuation of application Ser. No. 13/225,131, filed on Sep. 2, 2011, which is a divisional of application Ser. No. 11/027,860, filed on Dec. 30, 2004, issued on Sep. 27, 2011 as U.S. Pat. No. 8,024,898, the contents of which are fully incorporated herein by reference.

FIELD OF THE INVENTION

The present invention relates to a system and method for finishing fenestration openings.

BACKGROUND OF THE INVENTION

General contractors engaged in the construction of a commercial or residential building are responsible for scheduling various subcontractors to complete their assigned tasks in a timely manner. When a certain subcontractor's work is delayed for some reason, further delays may be caused for other subcontractors whose tasks are dependent on the first subcontractor. For instance, plumbing and electrical work must be completed before interior drywall can be hung; likewise painting and finishing cannot proceed until the drywall is hung. To the extent that a job can be planned so that as few subcontractors are dependent on the completion of each other's work as possible, a smoother job with fewer delays is likely to result.

While better scheduling and planning on the part of the general contractor can reduce these bottlenecks, some are unavoidable due to requirements imposed by current building materials. For example, fenestration openings are unfinished openings in the side of a building which will ultimately receive a window or door assembly. Currently, windows are delivered by the manufacturer having a frame which is attached to the framing members of the fenestration opening. Until this frame is installed, the finishing crews, which apply the exterior finish such as plastering to the building as well as the interior drywall crews, cannot complete their work. Accordingly, delays in shipment and installation of the windows and frames lead to significant problems in work scheduling for the building as a whole, which can potentially cause an entire job to fall behind schedule.

A need exists for a system and method which reduces the need for a high degree of coordination between subcontractors. With such a system and method, the burden on the window and door manufacturers to deliver on a tight schedule is reduced, and the general contractor regains a degree of control over his schedule without worrying about being held up by his custom window and door suppliers not delivering on time.

SUMMARY OF THE INVENTION

Accordingly, a fenestration cap system is provided as a separate piece from the frame of the window. The fenestration cap can be installed prior to the delivery of the widows and accompanying frames, and allows interior and exterior finishing to be completed without having to install the window and door systems. This allows more time for custom window and door orders to be filled by the supplier without holding up progress in other areas of the job. The waiting for the actual windows to arrive and be installed is no longer one of the critical paths of the job schedule, and may be completed at the convenience of the contractor.

This system is compatible with the frames of major door and window suppliers, and gives consumers the flexibility to choose the windows and doors that best fit their specific needs without being forced to make a selection due to manufacturer lead times. Furthermore, the present system is easy to install, and can be done by tradesmen with minimal training. The inclusion in certain embodiments of the present invention of flanges and stops reduces the need for careful measuring and placement of finishing materials such as drywall sheeting.

The fenestration cap system allows window and door openings to be made ready to receive their corresponding accessories, while at the same time being easily made weatherproof in the absence of these accessories with the addition of a simple piece of panel or sheeting.

Additional benefits are provided if accessories such as windows and doors are installed after finishing crews complete their work, which may include the application of plaster to the outside of the storefront, or the installation of drywall along the inside. In this case, The window and door systems installed within the fenestration cap do not need to be masked off by the finishing crews, and they are not in danger of being damaged by the finishing crews.

In one embodiment of the present fenestration cap system, future window replacement can be achieved by simply removing the window fasteners holding the window and possibly the frame within the fenestration cap, cutting out the perimeter window sealant, and sliding the window out leaving the integrity of the structural and building substrates in a finished undisturbed state.

In an exemplary embodiment, a window sill comprises a structural base having a first side and a second side, a fenestration cap attached to the structural base, a window frame mounted on the fenestration cap, and finish elements applied to the structural base and adjacent to the fenestration cap. The window frame may be removed from the fenestration cap without disturbing the finish elements.

In an alternative embodiment, a fenestration cap comprises a first surface for receiving a window and a second surface attached to the first surface for attachment to a fenestration opening. The window is separably detachable from the first surface and the fenestration opening is detachable from the second surface. Furthermore, detachability of the window from the first surface is independent of detachability of the fenestration opening from the second surface.

A method of installing a window in a window opening comprises providing a window opening and preparing the window opening for receiving a fenestration cap, installing a fenestration cap by placement within and attachment to the window opening in a primary step, and installing a window within the window opening by placement within and attachment to the fenestration cap in a secondary step.

Figure 1:
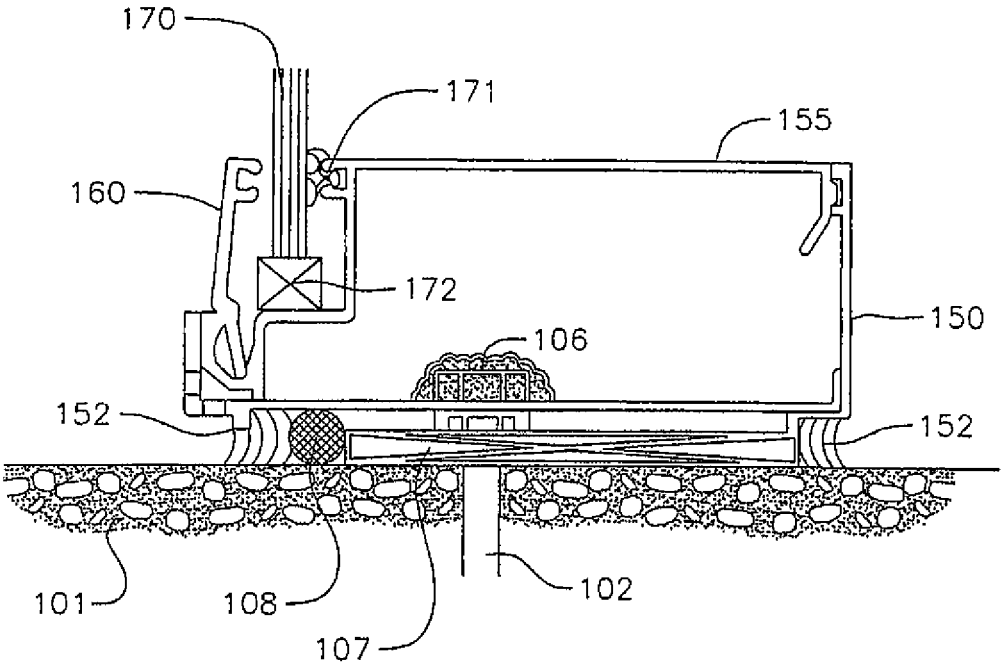
FIG. 1 PRIOR ART
FIG. 1 shows a side view of a prior art commercial window assembly.

Before any embodiment of the invention is explained in detail, it is to be understood that the invention is not limited in its application to the details of construction and arrangements of components set forth in the following description, or illustrated in the drawings. The invention is capable of alternative embodiments and of being practiced or being carried out in various ways. Also, it is to be understood that the terminology used herein is for the purpose of illustrative description and should not be regarded as limiting.

DETAILED DESCRIPTION OF THE INVENTION

The present fenestration cap was designed to systematically coordinate and weatherproof fenestration openings before the installation of commercial or residential windows or doors. In one embodiment, the fenestration cap is a permanent fixtures in the building in which it is installed. The present cap allows for plastering and installation of interior drywall to be completed after installation of the fenestration cap itself, all of which may be completed at the leisure of a general contractor before delivery of the windows and associated frames is even taken. As such, a delay in such delivery will not unnecessarily inconvenience the contractor and delay the job; plasterers and finishing crews no longer need to wait for the delivery of windows to a job site to complete their portions of the build.

Once the windows and frames do arrive, they can be installed separately by attachment to the fenestration cap with sheet metal screws or other appropriate fastening means. Furthermore, if the window panes themselves ever need to be replaced, the frames in which they are mounted can be easily detached from the fenestration cap without the need to remove the cap itself. Formerly, the unitary frame in which windows were mounted and which was attached directly to the window opening necessitated a complete tear-out of the window opening to replace the window itself. As such, windows and doors are made independent and easily replaceable building components rather than permanent parts of the building structure.

FIG. 1 is a side view of a prior art commercial window assembly showing a nail on concrete slab detail. A sill can 150 is attached directly to a concrete slab 101 using a fastener 102. A pair of caulk beads 152 are also shown at the periphery of the interface between the sill can 150 and the concrete slab 101. A sealant 106 is used to waterproof the intersection of the fastener 102 and the sill can 150. A shim 107 may be used to position the sill can 150 on the concrete slab 101. Also, backer rods 108 may be used to provide a stop for the application of the caulk bead 152.

Such an arrangement is known by those skilled in the art to be prone to leakage. The sill can 150, together with a sill can filler 155 and a sill can stop 160 forms a frame assembly which secures a window 170. One or more top load gaskets 171 as well as a setting block 172 may also be used with this assembly to further secure, cushion and waterproof the window 170.

With the embodiment shown, finish work on the window opening may only be completed once the window 170 and frame arrives. As such, the scheduling problems discussed above are common with this prior art embodiment. Furthermore, if the window 170 and frame needed to be changed, any plastering and drywall used to finish the window opening would have to be removed at that time.

Figure 2:
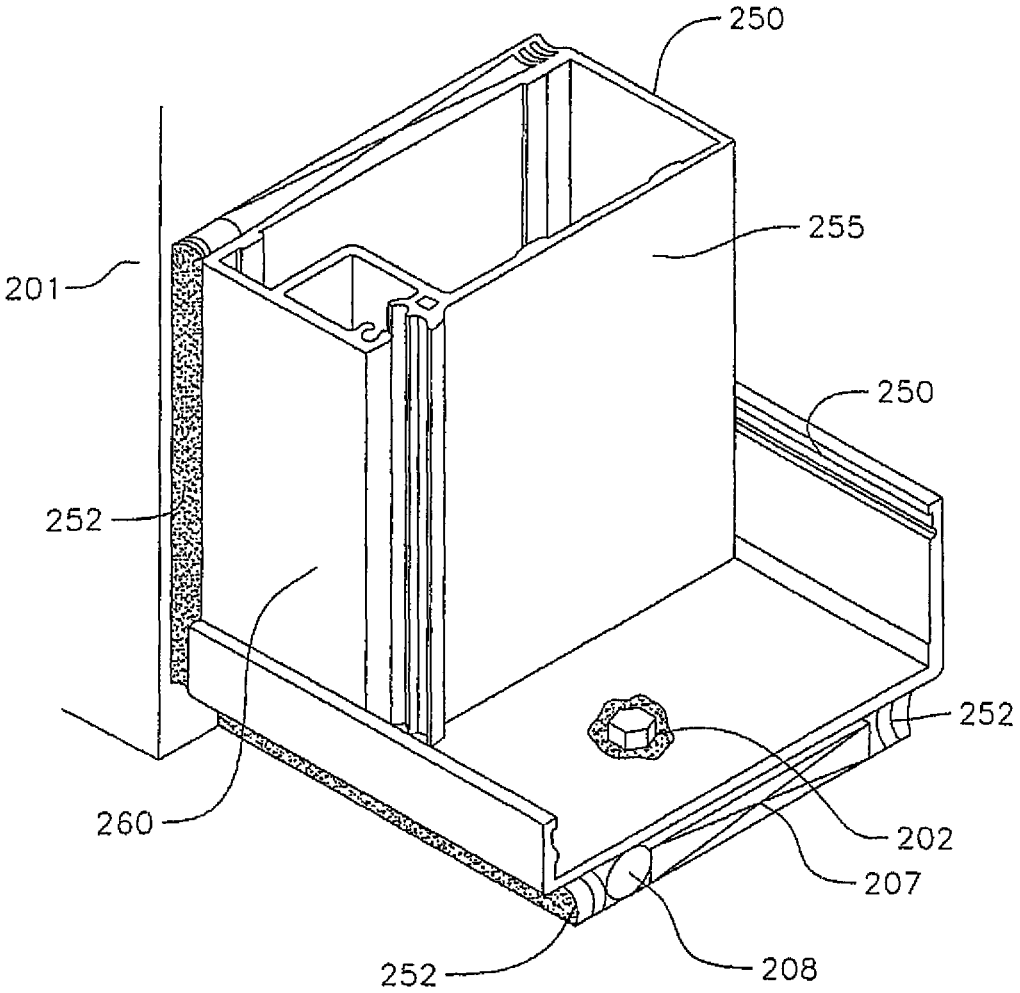
FIG. 2 PRIOR ART
FIG. 2 shows an isometric view of a prior art window assembly.

FIG. 2 shows an isometric view of a prior art window assembly of a similar type to that shown in profile in FIG. 1. Here, a vertical sill can 250 forms an assembly together with a sill can filler 255 and a sill can stop 260 to receive a window. The vertical sill can 250 is sealed to a jamb 201 using a caulk bead 25. The vertical sill can 250 is shown at right angles to a horizontal sill can 250 which is secured to its mounting platform using a fastener 202.

Figure 3:
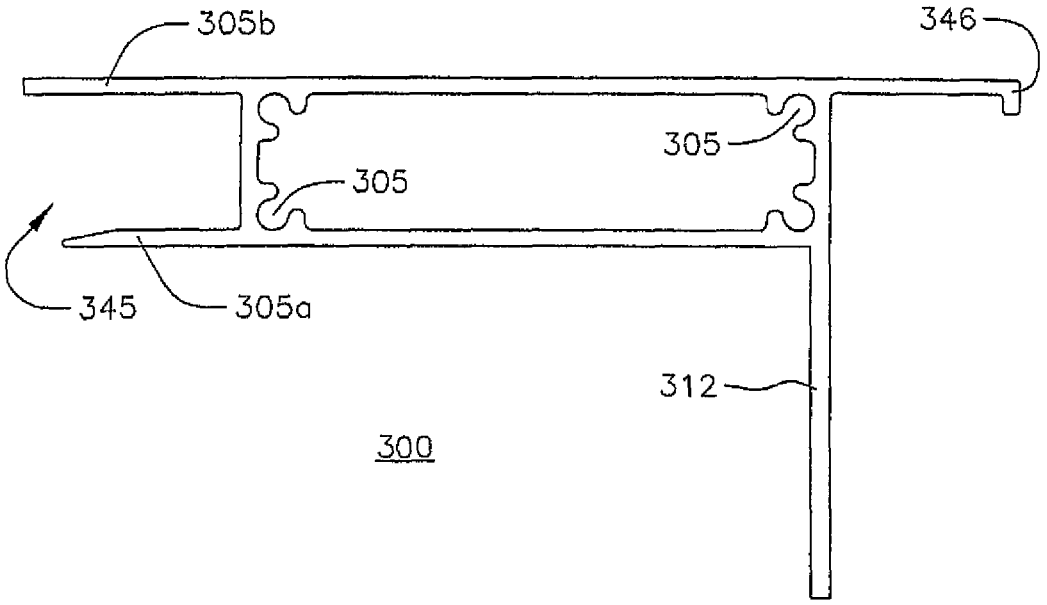
FIG. 3 shows a fenestration cap according to one embodiment of the present invention.

FIG. 3 shows a fenestration cap 300 according to a simplified embodiment of the present invention. Alternative fenestration caps are discussed in greater detail with reference to the following figures. Here, a fenestration cap 300 is shown having a vertical flashing 312, a drywall channel 345 and a plaster key 346, in addition to one or more screw races 305. The dry wall channel is defined between a mounting flange 305 and a top side 305*b*. The fenestration cap 300 is an independent piece separate from any sill can or window frame assembly which may be independently installed from the window to act as a terminal point for plaster and drywall installation as well as other finish work.

Figure 4:
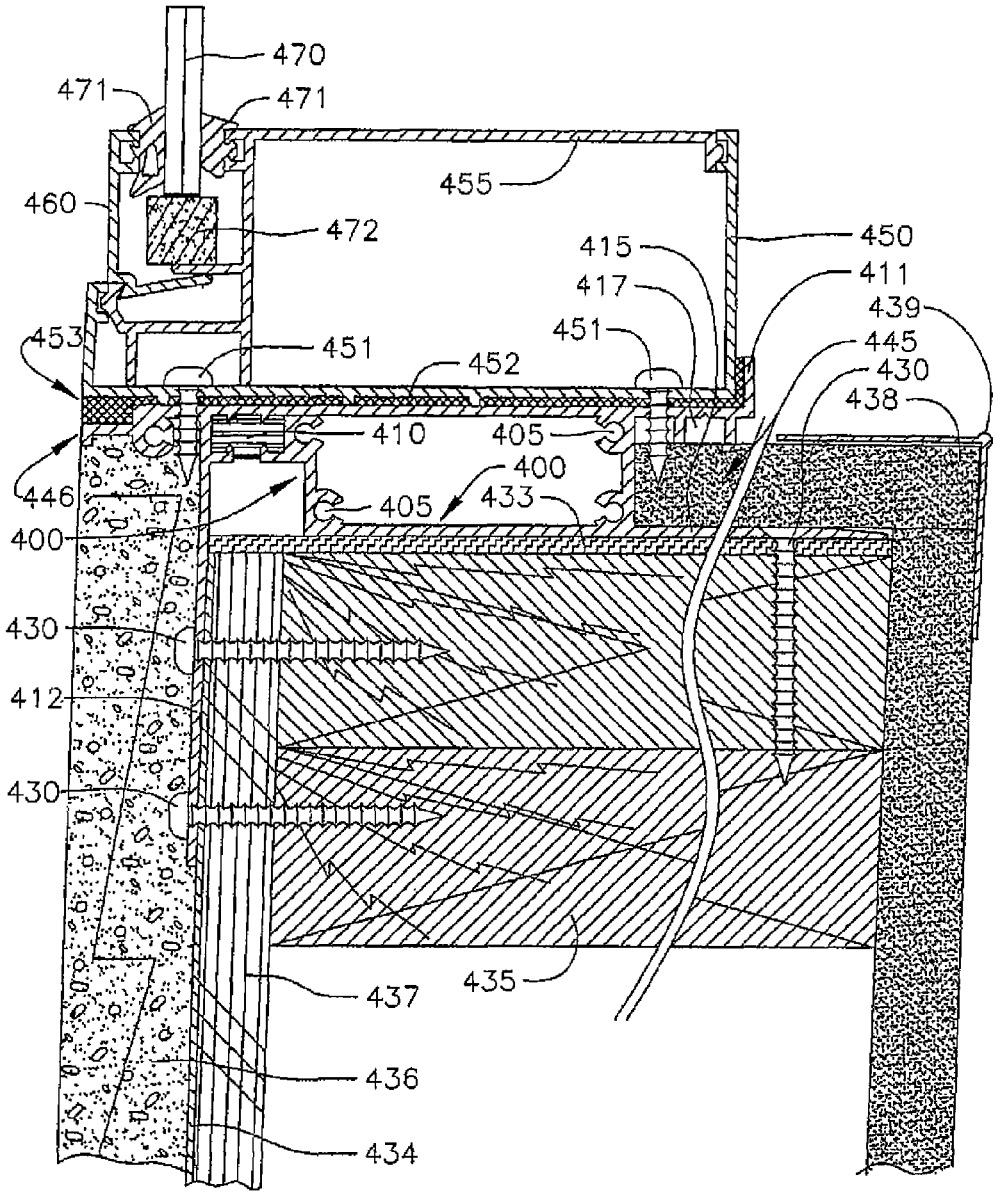
FIG. 4 shows a fenestration cap having a built in plaster key and a channel in the interior side according to another embodiment of the present invention.

FIG. 4 shows one embodiment of a fenestration cap 400 according to the present invention. The cap shown in FIG. 4 is being used in a window opening framed by wood framing members 435 and faced on the exterior side by plywood sheeting 437. FIG. 4 shows a sill can 450 supporting a window 470. As is known to one skilled in the art, a head can of a like, though not necessarily identical design, may be used to support the top edge of the window 470 in a storefront. Similarly, the fenestration cap 400 may be used to finish the top of the window opening rather than the bottom as is shown in FIG. 4 so as to provide a platform for attachment of the head can.

As discussed above, finishing crews are responsible for the installation of the plaster 436 and drywall sheeting 438, but these elements cannot be installed until a terminal point is provided for them to be finished against. In the prior art, this terminal point was provided by the sill can or frame of the window itself. However, this caused the previously mentioned problems of delays in construction while the finishing crews waited for the window and associated sill can and frame to be delivered.

In the embodiment shown in FIG. 4, a fenestration cap 400 is provided as a single piece separate from any sill can or window frame; as such it may be independently installed and acts as a terminal point for plaster and drywall installation. To this end, the fenestration cap 400 includes a plaster key 446 on its exterior side. The front edge of the plaster key 446 is designed to act as a guide for the tradesperson applying the plaster 436; a trowel may easily be drawn along this edge of the plaster key 446 to quickly and neatly apply an even layer of plaster to the assembly. In one embodiment, the plaster 436 is applied to a depth of ⅞". As mentioned above, because the fenestration cap 400 is provided as a single separate piece, plaster may be applied to the plaster key 446 prior to the installation of the window or frame, avoiding the risk of damage to these elements.

Similarly, in the shown exemplary embodiment, the fenestration cap 400 includes a base 415, a top side 417 generally parallel to the base, as well as a first support 419 and a second support 421 between the base and the top side. The key 446 has at least a portion that extends perpendicularly from a side 411 defining a flashing 412, and along the same plane as the top side 471. The exemplary embodiment fenestration cap also includes a drywall channel 445 provided as a guide to receive a piece of drywall sheeting 438 such as standard ⅝" sheetrock. This channel aids an unskilled laborer in the installation of interior drywall, plaster or paneling. The built in receiving and self-aligning channel creates a level fit for the installation of interior finish materials. Accordingly, the sheeting running from a corner bead 439 to the fenestration cap 400 can be quickly and accurately installed in a level position without the time consuming process of shimming or manual adjustment of the sheeting necessary with prior art systems.

In the embodiment of the present invention shown in FIG. 4, inserting the drywall sheeting 438 into the drywall channel 445 is all that is necessary to present a finished appearance for the inside of the window assembly. It is not necessary to tape or spackle the exposed joint between the drywall sheeting 438 and the fenestration cap 400 which lies below the water dam 411. Thus, further time and expense is saved in the installation process. The drywall channel 445 may include one or more vertical fins 417 therein, which aid in gripping the portion of drywall sheeting 438 inserted into the drywall channel 445. These fins also provide a cushioning effect for the drywall sheeting 438 during seismic activity.

In one embodiment of the present invention, the fenestration cap 400 is installed in the window opening using one or more wood screws 430 through the vertical flashing 412 and a mounting flange 415 to secure the fenestration cap 400 to the underlying structure of the window opening, namely the wood framing members 435 and/or the plywood sheeting 437. A vertical flashing 412 may be provided allowing the fenestration cap 400 to be attached to the plywood sheeting 437. A self healing membrane 434 may be placed between the vertical flashing 412 and the plywood sheeting 437 to provide further waterproofing for the underlying structure of the window opening. The self healing membrane 434 may be in one embodiment a continuous waterproof self healing rubberized membrane is manufactured from polypropylene. The vertical flashing 412 also provides additional waterproofing to the finished window assembly by providing a water barrier to any water which infiltrates behind the plaster 436. The fenestration cap 400 may be attached by its interior side with one or more additional wood screws 430 to the wood framing members 435.

An expansion cavity 433 may be provided between the fenestration cap 400 and the wood framing members 435 which may contain a foam strip, 3/16" thick in one exemplary embodiment to act as a shock absorber in the event of thermal or other expansion of the underlying members or seismic movement.

It will be understood by one skilled in the art that the inventive concepts of the invention described herein are not limited to a fenestration cap for use only with the specific materials discussed above, such as plaster and drywall for instance. In lieu of plaster for example, a variety of siding materials can be used to finished the exterior of the storefront assembly shown in FIG. 4. Likewise, plaster or paneling or a variety of other interior finishing materials may be used instead of the drywall sheeting 438 discussed above.

The fenestration cap 400 shown in FIG. 4 can be made from aluminum, vinyl, steel, plastic and other appropriate materials known to those skilled in the art. In one exemplary embodiment, the fenestration cap may be manufactured as an extruded aluminum piece in twenty-four foot lengths. This exceeds the length of typical extruded pieces used in window openings such as j-molds, for which the industry standard length is ten feet. Accordingly, with this embodiment of the present invention, the need for making time consuming splices between the lengths is reduced.

Furthermore, the width of the fenestration cap may be designed in various widths to fit various windows and window openings. The present invention is designed to work with window systems from multiple companies. As is known to one skilled in the art, the width of a commercial window is customarily measured with reference to its mullion width. These widths come in standard sizes including 2, 3, 4, 4.5 and 6 inches in width, among others. It is envisioned that a fenestration cap may be designed to match each of these standard window widths, although one skilled in the art will understand that a fenestration cap according to the present invention can be made to match any width window. FIG. 4 shows a window 4.5 inches in width, and the fenestration cap 400 shown therein has been designed to match a window of this width.

The fenestration cap 400 may be assembled in the contractor's shop or on the job site itself into a custom system for any size window opening by cutting stock lengths of the fenestration cap 400 at forty-five degree angles (or any other set of complementary angles). These lengths can then be attached to each other using fasteners passing through the integral screw races 405 of adjacent lengths of fenestration cap 400. For an aluminum fenestration cap, stainless steel sheet metal screws can be used as fasteners.

If the fenestration cap 400 is assembled in the contractor's shop and transported to the job site, a blank made of styrofoam or other material may be inserted into the center of the fenestration cap assembly to stiffen it for transport. This blank may be secured within the assembly using double-sided tape. Furthermore, after the fenestration cap is installed in the window opening, a blank secured within the fenestration cap 400 assembly using double sided tape may be also used to weatherproof the capped window opening in lieu of the window itself. Taped plastic sheeting may also be used for this purpose. In any event, fenestration cap assembly provides and easy base from which to tape or otherwise weatherproof a window opening prior to the installation of the window assembly.

The sill can 450 shown in FIG. 4 is an industry standard sill can having a number of interlocking parts. A sill can filler 455 and a sill can stop 460 snap into place within the sill can 450 to lock a window 470 in position. The window 470 is firmly held by a pair of top load gaskets 471, which may be neoprene gaskets. The sill can 450 is shown engaging window 470 through the pair of top load gaskets 471 and a setting block 472. These top load gaskets 471 are held partially snapped into receiving tracks in the sill can filler 455 and the sill can stop 460. These gaskets are also known to those skilled in the art as self-locking gaskets, given that the weight of the window 470 bears on these gaskets to create a seal between the gaskets 471 and the window 470.

In one embodiment of the present invention, at some point after the fenestration cap 400 itself has been installed in the window opening, the sill can 450, having a window 470 therein, may be lifted onto the length of fenestration cap 400 shown in FIG. 4. The sill can 450 can then be attached to the fenestration cap 400 using one or more sheet metal screws 451. In an exemplary embodiment, the window 470 may be surrounded on multiple sides by either a sill can or frame which abuts a length of fenestration cap to which the sill can or frame may be attached.

If the fenestration cap 400 is used with a frame such as the sill can 450 and related components shown in FIG. 4, the point of attachment of the sill can 450 to the fenestration cap 400 must be made waterproof. Accordingly, before the sill can 450 is attached to the fenestration cap 400 using the sheet metal screws 451, a caulk bead 452 is laid down therebetween to waterproof the joint. In one embodiment, the caulk used for the caulk bead 452 is structural grade silicone. At the portion of the joint nearest the exterior side of the storefront, a gap of set height 453 is provided which is designed to match the warranty requirements of the standard window sealants used in the industry. In the embodiment shown in FIG. 4, this gap has a height of ⅜ inches.

A water dam 411 may be provided at the interior side of the caulk bead 452 as a further moisture barrier in the event that water is able to infiltrate through to the interior side of the caulk bead 452. The water dam 411 also provides a stop allowing for easy installation of the window and sill can 450. Once the fenestration cap 400 is in place in a window opening, an unskilled laborer would easily be able to install the sill can 450 and related components to provide a finished storefront by lifting the window assembly up and into the opening within the fenestration cap assembly, placing the interior edge of the sill can 450 firmly against the water dam 411. As such, no measuring is required for the installation of the window assembly itself when the fenestration cap 400 has been used to frame the window opening ahead of time.

Furthermore, even if despite all the precautions built into the design of the fenestration cap 400, water is able fully infiltrate the joint in the area of the caulk bead 452 and pass over the water dam 411, the fenestration cap 400 fully spans the width of the window opening in which it is placed so that any water which does manage to flow over the fenestration cap 400 is directed over, rather than into, the wall on which the fenestration cap 400 rests.

The fenestration cap 400 may be provided with a thermal break 410 to reduce the transfer of heat through the fenestration cap 400 to help meet energy efficiency building requirements such as California's. Title 24 requirements. Accordingly, an insulation material is formed in a cavity of the fenestration cap 400. This insulation material has sufficient strength such that after it is formed in the cavity, a portion of the fenestration cap 400 can be removed in the vicinity of the insulation such that the fenestration cap 400 becomes two thermally separate pieces joined only by the insulation. This helps to substantially thermally isolate the interior from the exterior of the finished storefront by preventing heat transmission through the fenestration cap 800.

The fenestration cap 400 has the additional advantage that over prior art systems in that it can span doorway openings in a storefront and need not be trimmed to the jamb of a doorway. With the addition of a separate threshold unit, the section fenestration cap 400, spanning the bottom of a doorway, presents a finished appearance. Accordingly, a single length or series of lengths of the fenestration cap 400 can be made to span the base of an entire storefront serving as both a sill of a window and a door threshold.

Figure 5:
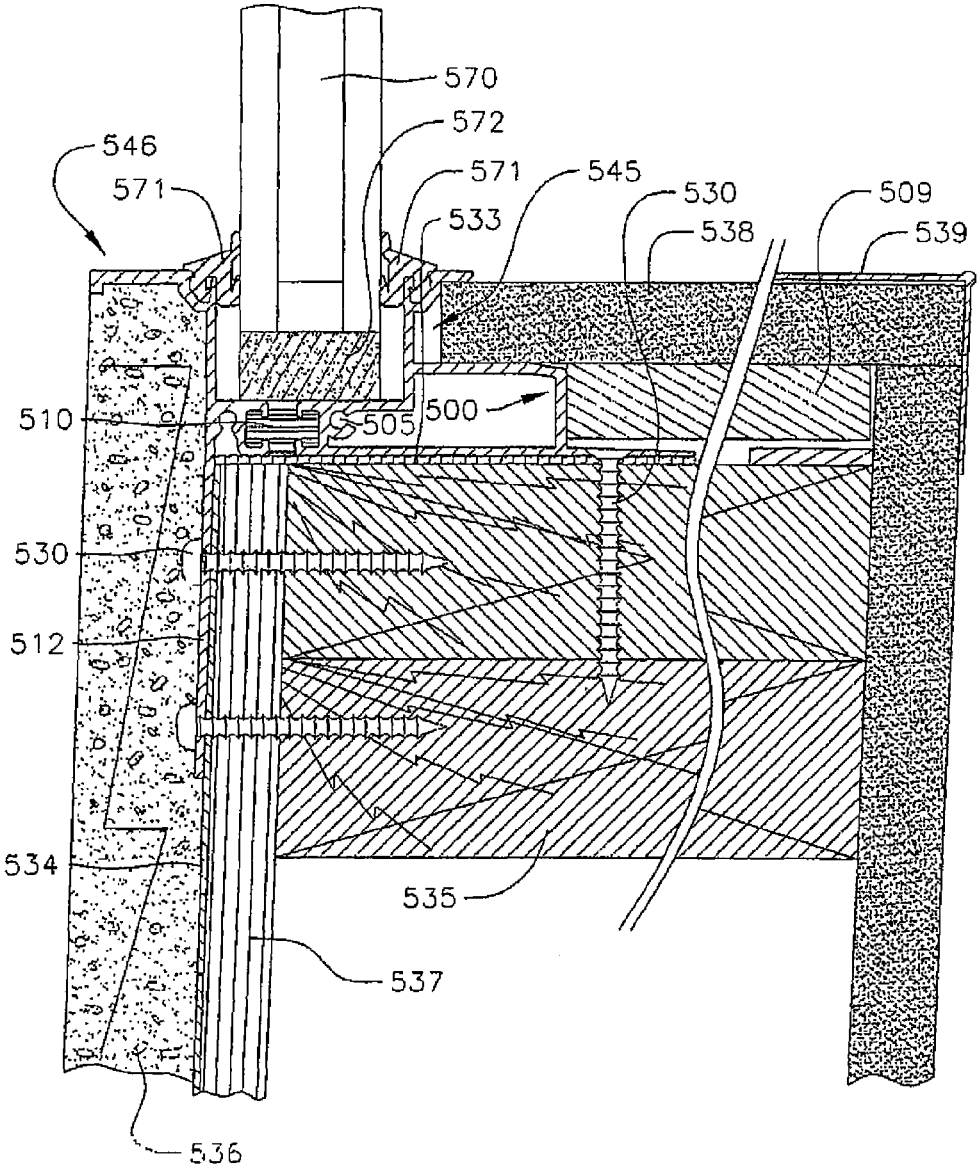
FIG. 5 shows a recessed fenestration cap having a built in plaster key and a flush interior side according to one embodiment of the present invention.

FIG. 5 shows a fenestration cap 500 for use with a frameless window system. While the fenestration cap 500 shares many of the same elements as the cap shown in FIG. 4, the cap 500 is shown engaging the window 570 through a top load gasket 571 and a setting block 572, rather than incorporating a separate sill can, as is the case in the cap of FIG. 4. In one embodiment, the top load gasket 571 may be provided by a silicone glazed bead.

As in the previous embodiment, the fenestration cap 500 is attached to the wood framing members 535 and plywood sheeting 537 using a series of wood screws 530. The fenestration cap 500 is provided with a drywall channel 545 and plaster key 546 designed to receive drywall sheeting 538 and plaster 536. A spacer 509 may be provided to support the drywall sheeting 538 in the area of a corner bead 539.

Figure 6:
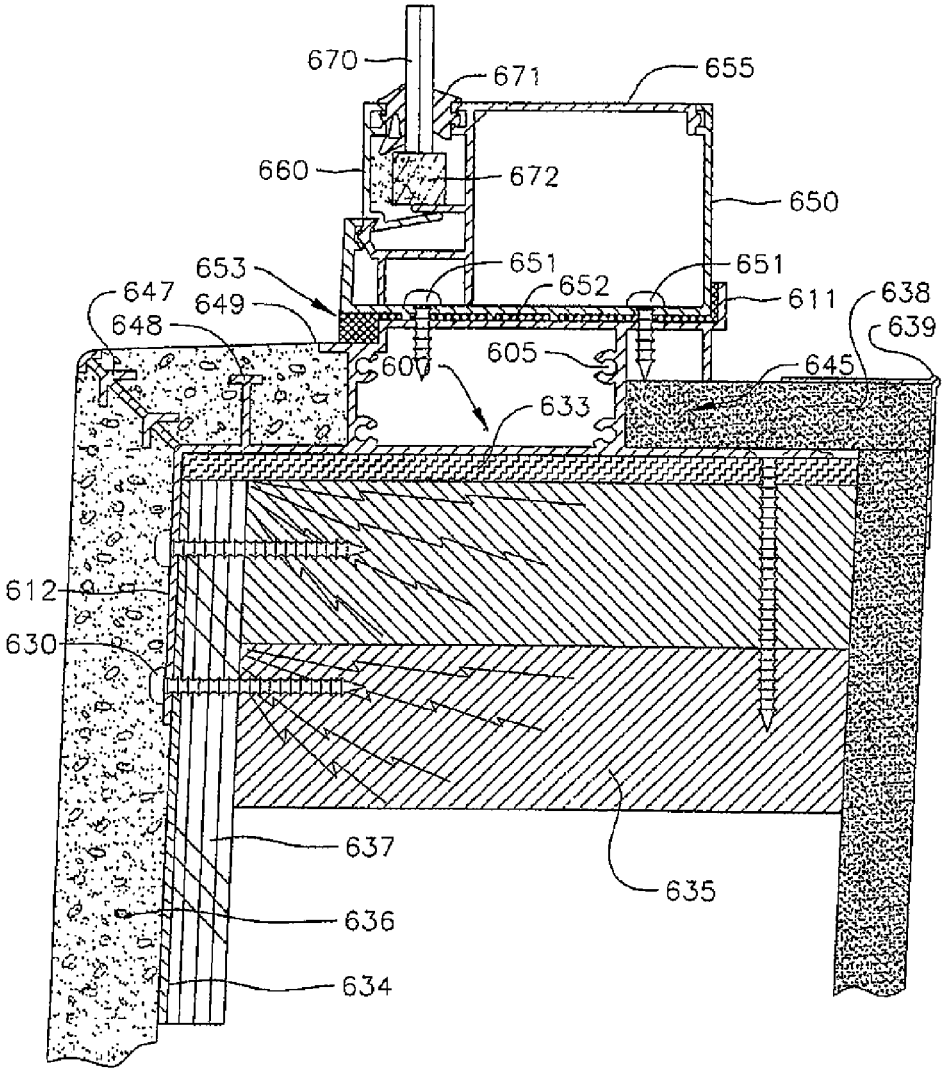
FIG. 6 shows a recessed fenestration cap having a channel in the interior side according to one embodiment of the present invention.

FIG. 6 shows a recessed fenestration cap having a channel in the interior side according to one embodiment of the present invention. In FIG. 6, the top and front edges of the plaster key 647 and the top edge of the lip 649 are designed to act as guides to the tradesperson applying the plaster 436 to the assembly; a trowel may easily be drawn along these edges to quickly and neatly apply an even layer of plaster in the space between the plaster key 647 and the lip 649. The surface created by plastering between the plaster key 647 and the lip 649 will not be completely horizontal however; the fenestration cap 600 is designed so that when level, the top edge of the plaster key 647 lies on a 2% decline from the horizontal with respect to the top edge of the lip 649. This encourages water to shed off of the architectural reveal created by this plastered surface toward the exterior of the storefront. Furthermore, the fenestration cap 600 is provided with a serrated texture 648 to better anchor the plaster to the fenestration cap 600. Also, the plaster key 647 is provided with holes drilled therein (not shown) so that the plaster applied below the plaster key 647 and the plaster applied to the side of the plaster key 647 is able to form one contiguous and stable mass, leading to increased durability. FIG. 6 also depicts one of two sheet metal screws 651 entering a cavity. In some embodiments of the present invention, one or more sheet metal screws is used to affix the sill can 650 to the fenestration cap. If water leaks under the sill can and above the fenestration cap, it could leak down through the sheet metal screw 651 hole. However, if the screw hole goes through a portion of the fenestration cap into the cavity, the cavity will serve as a reservoir to hold the water, preventing water from entering into the interior, and trapping water in the cavity until it evaporates.

Figure 7:
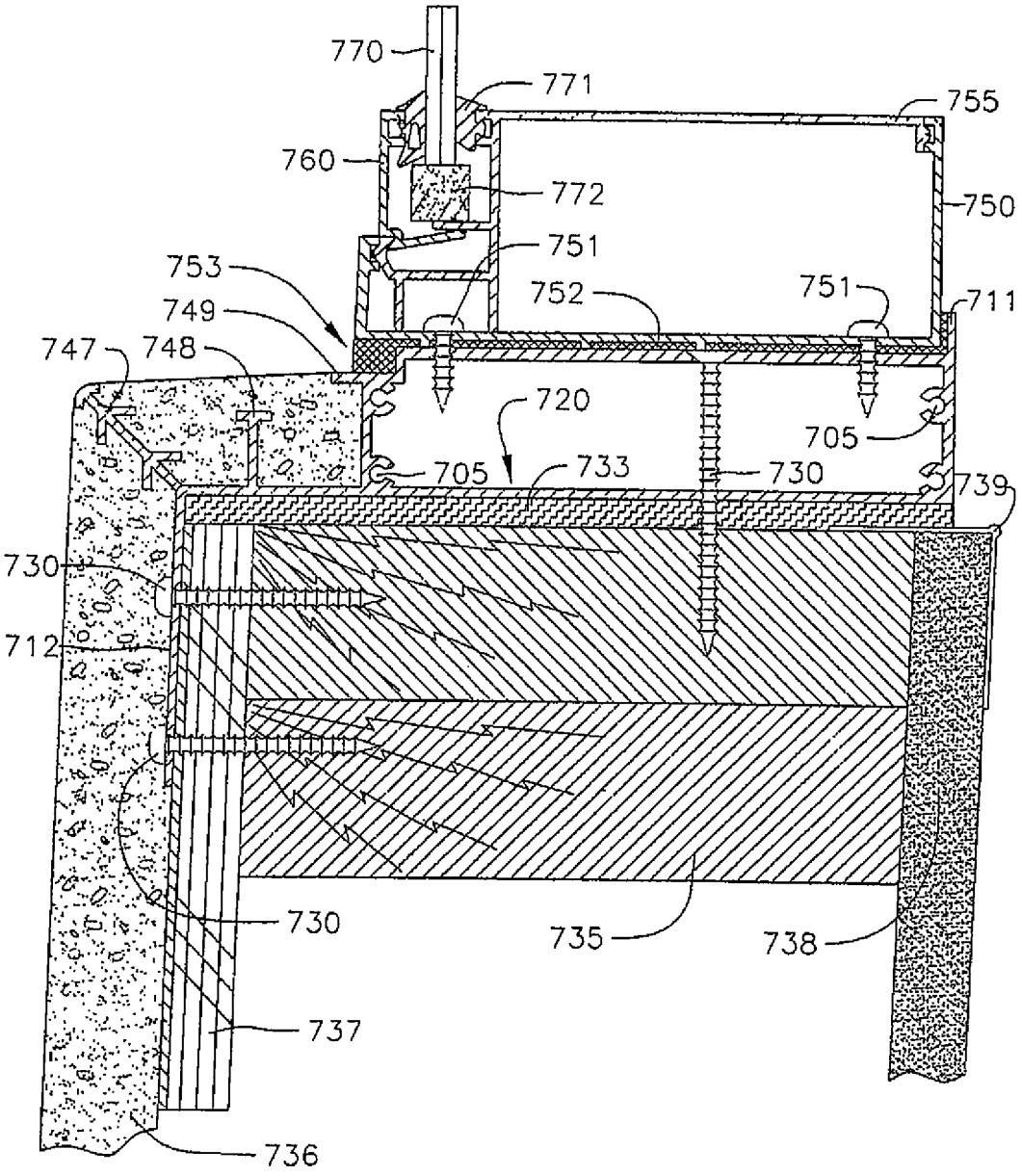
FIG. 7 shows a recessed fenestration cap having a flush interior side according to one embodiment of the present invention.

FIG. 7 shows a recessed fenestration cap 700 having a flush interior side according to one embodiment of the present invention. The fenestration cap 700 is attached to the wood framing members 735 and plywood sheeting 737 using a series of wood screws 730. The fenestration cap 700 is attached to an assembly comprising a sill can 750, sill can filler and 755 sill can stop 760 using sheet metal screws 751 and a caulk bead 752. This assembly is shown engaging the window 770 through a top load gasket 771 and a setting block 772. In contrast to FIGS. 4, 5 and 6 however, the fenestration cap 700 is not provided with a drywall channel designed to receive drywall sheeting. Instead, the fenestration cap 700 is designed as a relatively flush assembly which may be placed over a corner bead 739 applied to finish the joint between the drywall sheeting 738 and the wood framing members 735.

Figure 8:
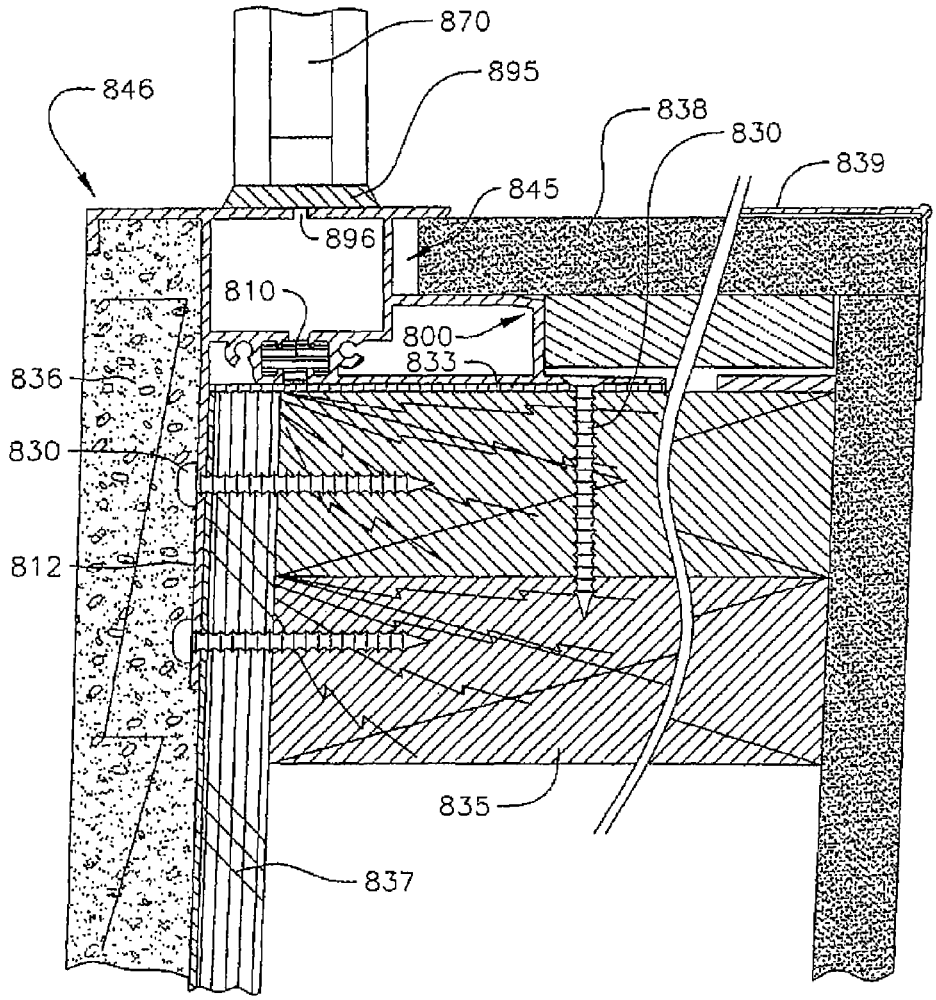
FIG. 8 shows a fenestration cap having a built in plaster key which is attached to a window pane using a caulked butt joint.

FIG. 8 shows a fenestration cap 800 attached to a window 870 using a butt joint 895. The arrangement shown in FIG.

8 is a counterpart to the fenestration cap 500 of FIG. 5 for use with a frameless window system. While the fenestration cap 500 supports the sill of a window in a frameless window system, the fenestration cap 800 may be applied to the jamb of such a window opening to support the sides of the window 870.

As in the previous figures, the fenestration cap 800 is provided with a plaster key 846 to facilitate the easy application of the plaster 836, and a drywall channel 845 to facilitate the installation of the drywall sheeting 838. The fenestration cap 800 is secured to the wood framing members 835 and the plywood sheeting 837 using one or more wood screws 830. Furthermore, the fenestration cap 800 is provided with a thermal break 810, which may be supplemented with the creation of a saw cut 896 in the fenestration cap 800 to substantially thermally isolate the interior from the exterior of the finished storefront, preventing heat transmission through the fenestration cap 800.

Figure 9:
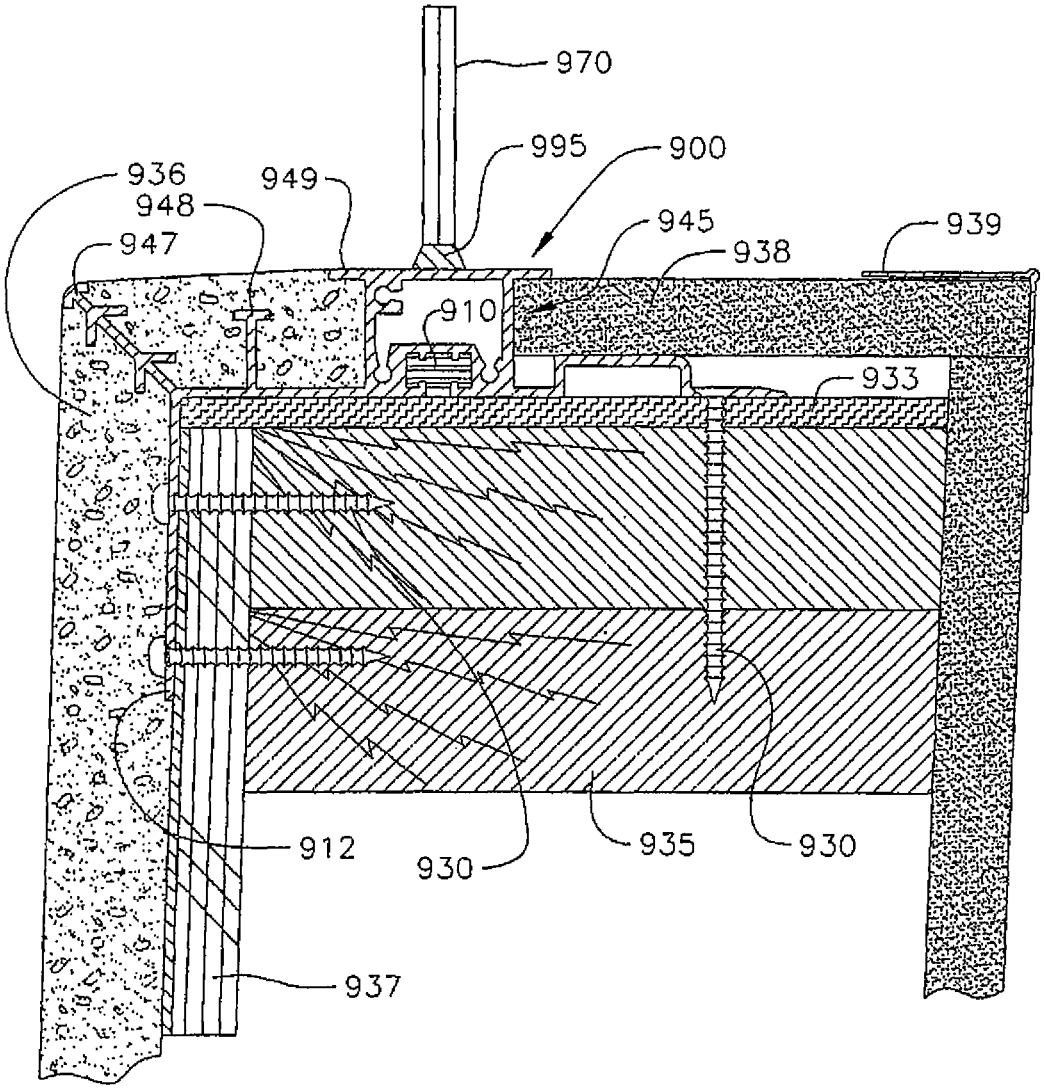
FIG. 9 shows a recessed fenestration cap having a built in plaster key which is attached a window pane using a caulked butt joint.

FIG. 9 shows a recessed fenestration cap 900 having a built in plaster key 947 which is attached a window pane using a caulked butt joint. The fenestration cap 900 is similar to the fenestration cap 800 of FIG. 8 in that it may be applied to the jamb of a window opening in a frameless window system to support the window therein. However, it differs in that it features a set back similar to that used in the fenestration cap 600 of FIG. 6, wherein the top and front edges of the plaster key 947 and the top edge of the lip 949 are designed to act as guides to the tradesperson applying the plaster 936 to the assembly.

As in FIG. 6, the surface created by plastering between the plaster key 947 and the lip 949 will not be completely horizontal. The fenestration cap 900 is designed so that when level, the top edge of the plaster key 947 lies on a slight decline from the horizontal with respect to the top edge of the lip 949. This encourages water to shed off of this architectural reveal toward the exterior of the storefront. The fenestration cap 900 is also provided with a serrated texture 948 to better anchor the plaster 936 to the fenestration cap 900.

Figure 10:
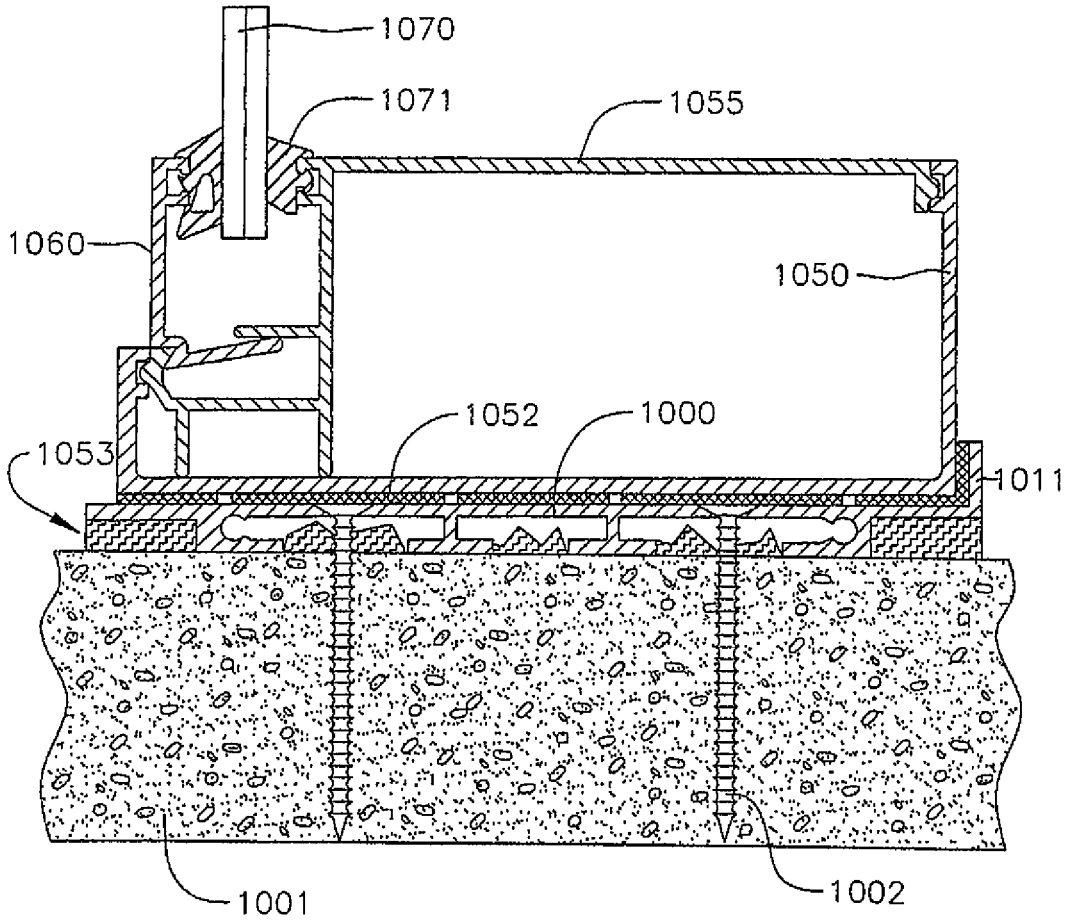
FIG. 10 shows a sill detail of a fenestration cap anchored to a concrete slab.

FIG. 10 is an alternative embodiment of the present invention wherein a sill detail a fenestration cap 1000 shown is anchored to a concrete slab 1001 using a fastener 1002. The concrete slab 1001 may be part of an overhanging eve. In place on the fenestration cap 1000 are a sill can 1050, a sill can filler 1055, and a sill can stop 1060 which, though the top load gaskets 1071 secure the window 1070.

The gap between the sill can 1050 and the fenestration cap 1000 is sealed with a caulk bead 1052. As in other embodiments, a gap of set height 1053 is provided as part of the caulk bead 1052 to match industry standard warranty requirements. A water dam 1011 is provided at the interior side of the caulk bead 1052 as a moisture barrier in the event that water is able to infiltrate through to the interior side of the caulk bead 1052, and to provide a stop for easy installation of the sill can 1050.

The embodiment of FIG. 10 additionally shows that the fenestration cap 1000 is slightly wedge shaped; having a narrower edge on the exterior side. As such, water will be more inclined to run to the outside of the window 1070 both if it infiltrates between the fenestration cap 1000 and the sill can 1050, and if it gets into the sill can 1050 itself. In prior art models, if water infiltrated the sill can 1050 for example by flowing between it and the sill can filler 1055, it would pool within the sill can. Weep holes were sometimes added in the sill can 1050 to aid in drainage, but cannot prevent pooling in the event of an unfavorable alignment of the sill can 1050 itself.

Figure 11:
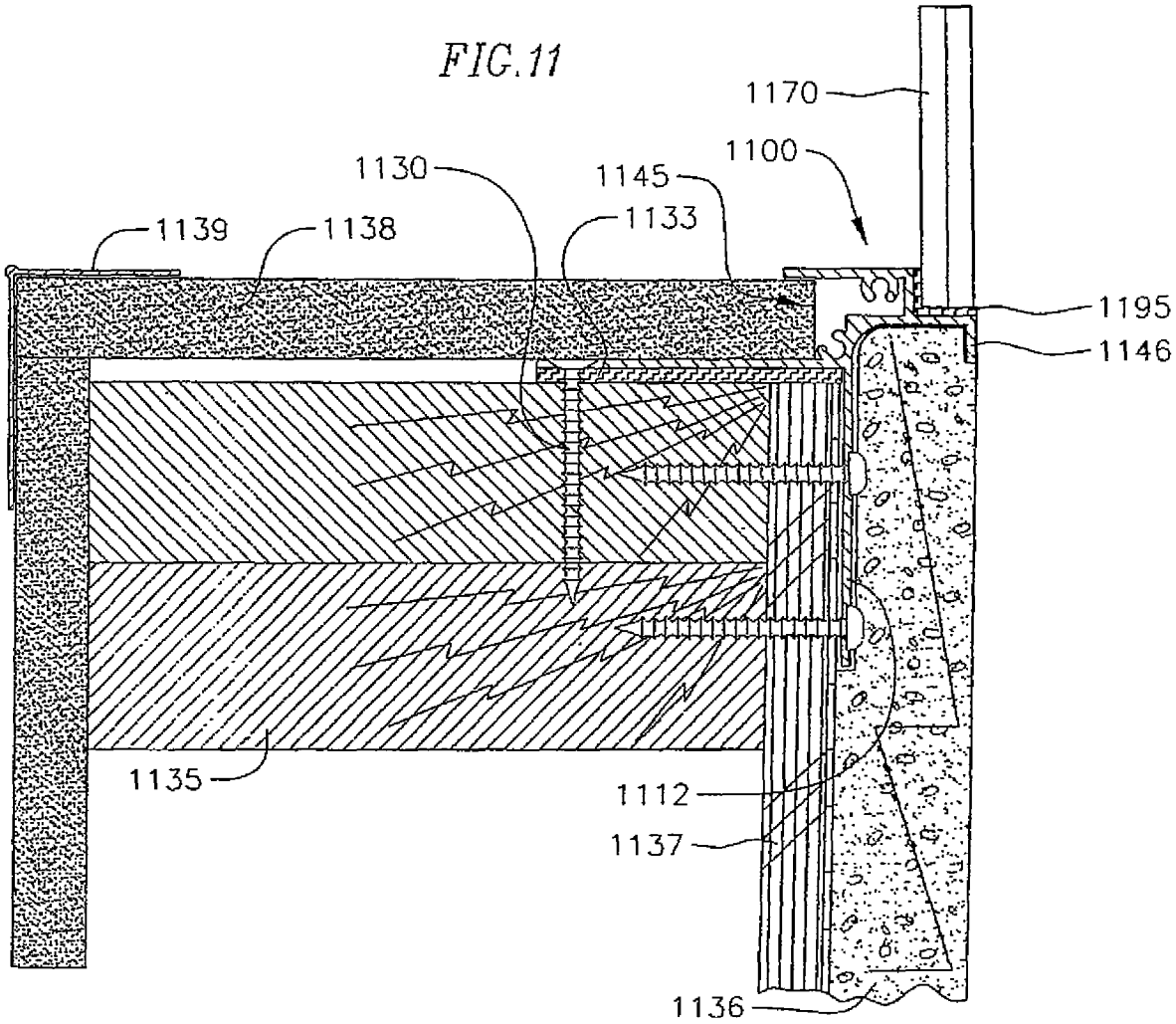
FIG. 11 shows a fenestration cap according to an alternative embodiment of the present invention.

FIG. 11 shows a fenestration cap 1100 according to an alternative frameless embodiment of the present invention wherein the window 1170 is mounted directly on the fenestration cap 1100 using a caulk joint 1195. As is the previous figures, the fenestration cap 1100 is provided with a plaster key 1146 to facilitate the easy application of the plaster 1136, and a drywall channel 1145 to facilitate the installation of the drywall sheeting 1138. The fenestration cap 1100 is secured to the wood framing members 1135 and the plywood sheeting 1137 using one or more wood screws 1130.

Figure 12:
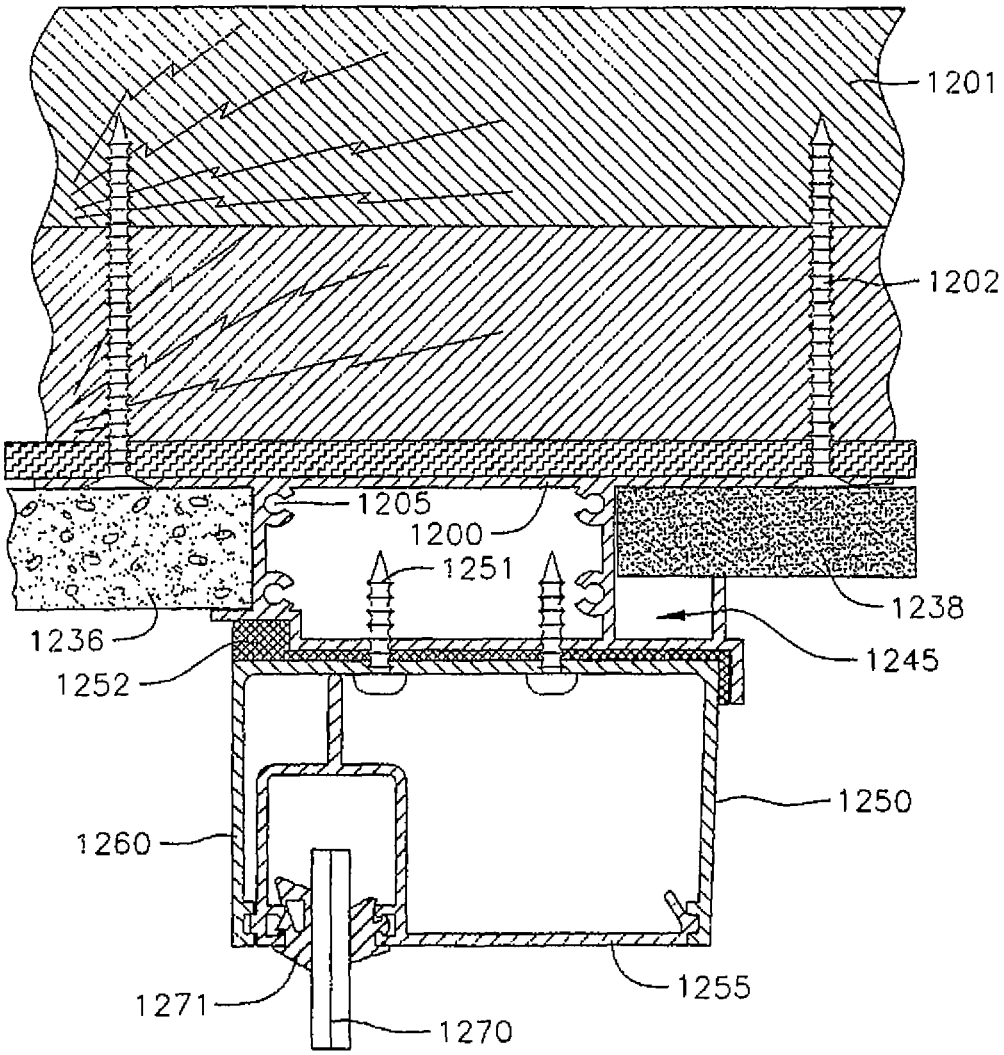
FIG. 12 shows a head detail of a fenestration cap anchored to a concrete slab.

FIG. 12 shows a head detail of a fenestration cap 1200 anchored to an overhang 1201. The fenestration cap 1200 is of a type which can be attached on a continuous eve or overhang 1201 without need of a flange. In the embodiment shown, the fenestration cap 1200 is attached using the fastener 1202. On the fenestration cap 1200 is mounted an assembly comprising a sill can 1250, sill can filler 1255 and sill can stop 1260. This assembly may be mounted using sheet metal screws 1251, and seamed using a caulk bead 1252. A window 1270 may be mounted in this assembly using top load gaskets 1271. The fenestration cap 1200 may be installed before the sill can 1250 to allow for the completion of work involving the plaster 1236 and drywall sheeting 1238, the latter of which fits easily into the drywall channel 1245.

The preceding description has been presented with reference to some embodiments of the invention. Workers skilled in the art and technology to which this invention pertains will appreciate that alterations and changes in the described structure may be practiced without meaningful departing from the principal, spirit and scope of this invention. Accordingly, the foregoing description should not be read as pertaining only to the precise structures and methods described and illustrated in the accompanying drawings, but rather should be read consistent with and as support to the following claims which are to have their fullest and fair scope. For instance, FIG. 10 depicts a fenestration cap that is slightly wedge shaped, and thus parts of the fenestration cap may not be perfectly parallel or perfectly perpendicular in reference to one another. Therefore, as used herein, parallel and perpendicular could mean substantially parallel and substantially perpendicular.

What is claimed is:

1. A method of installing a window or a door system including at least one of a frame and a sill in an opening formed in a structural wall, said wall having a first face opposite a second face and a thickness there-between defining a periphery of said opening, wherein the opening extends from the first face to the second face, the method comprising:

placing a fenestration cap on at least substantially the entire periphery of said opening, the fenestration cap having a key extending beyond the first face in a first direction away from the first and second faces, a channel extending in a second direction opposite the first direction and toward the second face, and a first surface extending at least between the key and the channel;

placing a first finish element along the first face, wherein the key provides a guide for receiving at least a portion of the first finish element;

placing at least a portion of a second finish element within the channel in a direction transverse to said first and second faces; and mounting a window or door system including said at least one of a frame and a sill on said first surface after said fenestration cap is placed in the opening, wherein said window comprises a periphery adjacent to said periphery of said opening wherein said first surface is between said opening periphery and said window periphery.

2. The method as recited in claim 1, wherein mounting comprises mounting the window or door system on said first surface after both of said first and second finish elements are placed.

3. The method as recited in claim 1, wherein the key extends generally perpendicular to the first face.

4. The method as recited in claim 1, wherein the key extends at an angle relative to the first face.

5. The method as recited in claim 1, wherein the fenestration cap comprises a flashing and wherein placing a first finish element comprises placing the first finish element over the flashing wherein the flashing is sandwiched between the first face and the first finish element.

6. The method as recited in claim 1, wherein the first finish element is stucco.

7. The method as recited in claim 1, wherein the fenestration cap comprises a second surface spaced apart and opposite the first surface, wherein the second surface interfaces with the opening periphery.

8. The method as recited in claim 1, wherein the key is flush with the first surface.

9. A method of installing a window or door in an opening comprising:

preparing the opening for receiving a fenestration cap, the opening having an interior periphery defining a perimeter of said opening and comprising a plurality of sides extending transversely relative to each other, wherein each side extends along a different portion of said perimeter of said opening;

installing a fenestration cap by placement within, and attaching to, the opening in a primary step, said fenestration cap comprising a periphery having a plurality of sides being adjacent to corresponding of said plurality sides of said opening periphery; and installing the window or door within the window opening by placement within and attachment to the fenestration cap in a secondary step.

10. A method for preparing an opening having a periphery to later receive a window or a door, the opening formed in a structural wall, said wall having a first face opposite a second face and a thickness there-between, wherein the opening extends from the first face to the second face, the method comprising:

placing a fenestration cap, excluding a sill, on at least substantially an entire periphery of the opening, the fenestration cap having a key extending beyond the first face in a first direction away from the first and second faces, a channel extending in a second direction opposite the first direction and toward the second face, and a first surface extending at least between the key and the channel;

placing a first finish element along the first face, wherein the key provides a guide for receiving at least a portion of the first finish element; and placing at least a portion of a second finish element within the channel in a direction transverse to said first and second faces.

11. The method of claim 1, wherein said window or door system includes a sill, and wherein mounting said window or door system on said first surface comprises mounting said sill on said first surface after said fenestration cap is placed in the opening.

12. The method of claim 1, wherein said window or door system includes a frame, and wherein mounting said window or door system on said first surface comprises mounting said frame on said first surface after said fenestration cap is placed in the opening.

13. The method of claim 1, wherein mounting a window or door system including said at least one of a frame and a sill on said first surface comprises mounting said window or door system including said at least one of said frame and said sill on said first surface after at least one of said first and second finish elements are placed.

14. The method of claim 13, wherein said window or door system comprises a sill, and wherein mounting a window or door system on said first surface comprises mounting said sill on said first surface after said at least one of said first and second finish elements are placed.

15. The method of claim 13, wherein said window or door system comprises a frame, and wherein mounting a window or door system on said first surface comprises mounting said frame on said first surface after said at least one of said first and second finish elements are placed.

16. The method of claim 1, further comprising fastening said channel to said opening periphery.

17. The method of claim 5, further comprising fastening said flashing to said wall.

18. The method of claim 1, wherein the opening periphery comprises two opposite generally horizontal ends and two opposite generally vertical ends extending between said two opposite generally horizontal ends and wherein the fenestration cap defines a quadrilateral having two opposite generally horizontal sections and two opposite generally vertical sections, wherein after placing the fenestration cap, each fenestration cap generally horizontal section is adjacent a corresponding opening periphery generally horizontal section and each fenestration cap generally vertical section is adjacent a corresponding opening periphery generally vertical section.

19. The method of claim 18, wherein said first surface on each of said generally horizontal sections is generally horizontal and said first surface on each of said generally vertical sections is generally vertical.

20. The method of claim 18, wherein each section of said fenestration cap is a separate section.

21. The method of claim 9, wherein the opening periphery plurality of sides comprises two opposite generally horizontal sides and two opposite generally vertical sides extending between said two opposite generally horizontal sides, and wherein the fenestration cap periphery defines a quadrilateral and wherein said fenestration cap plurality of sides comprises two opposite generally horizontal sides and two opposite generally vertical sides, wherein after attaching, each fenestration cap generally horizontal side is adjacent a corresponding opening periphery generally horizontal side, and each fenestration cap generally vertical section is adjacent a corresponding opening periphery generally vertical side.

22. The method of claim 21, wherein the window or door system is attached to at least a generally horizontal surface or a generally vertical surface of said fenestration cap.

23. The method of claim 21, wherein each side of said fenestration cap is a separate side.

24. The method of claim 9, wherein said window or door system comprises a plurality of sides onto each of which is mounted a sill or a frame and wherein said sill or frame is attached to a side of said plurality of sides of said fenestration cap.

25. The method of claim 10, wherein the opening periphery comprises two opposite generally horizontal ends and two opposite generally vertical ends extending between said two opposite generally horizontal ends and wherein the fenestration cap defines a quadrilateral having two opposite generally horizontal sections and two opposite generally vertical sections, wherein after placing the fenestration cap, wherein each fenestration cap generally horizontal section is adjacent a corresponding opening periphery generally horizontal section and each fenestration cap generally vertical section is adjacent a corresponding opening periphery generally vertical section.

26. The method of claim 25, wherein the window is attached to at least a generally horizontal surface or a generally vertical surface of said fenestration cap.

27. The method of claim 25, wherein each section of said fenestration cap is a separate section.

* * * * *